33-261 SR
11/11/80 XR 4,232,449

United States Patent [19]
Linenberger

[11] 4,232,449
[45] Nov. 11, 1980

[54] BORE SIGHTING APPARATUS

[76] Inventor: Darrell Linenberger, 512 Rigewood Dr., P.O. Box 177, Ulysses, Kans. 67880

[21] Appl. No.: 84,710

[22] Filed: Oct. 15, 1979

[51] Int. Cl.[3] ..... F41G 3/32
[52] U.S. Cl. ..... 33/235; 33/234; 33/275 R; 33/261; 33/297
[58] Field of Search ..... 33/234, 235, 261, 286, 33/263, 275 R, 233, 297; 89/41 R, 41 E, 41 B

[56] References Cited

U.S. PATENT DOCUMENTS

| | | | |
|---|---|---|---|
| 43,319 | 6/1864 | Maltby | 33/235 |
| 752,962 | 2/1904 | Eby | 33/261 |
| 1,625,060 | 4/1927 | Storm | 33/261 |
| 1,994,177 | 3/1935 | Nolan | 33/234 |
| 2,198,836 | 4/1940 | Patton | 33/286 |

*Primary Examiner*—William D. Martin, Jr.
*Attorney, Agent, or Firm*—Sughrue, Rothwell, Mion, Zinn & Macpeak

[57] ABSTRACT

The bore sighting apparatus or alignment device is comprised of a two-part ring hinged together and provided with a clamp for securing the ring on the muzzle of a howitzer. A pair of hinged witness sights are provided on the ring and a pair of arms extend outwardly from opposite sides of the ring. A vertical arm is hinged on the outer end of each arm with a target and leveling vile being disposed at the top of each vertical arm. A turnbuckle-type device is connected between the upper end of each vertical arm and the horizontal arm for adjusting the vertical arm to a true vertical position. The targets are comprised of a cylinder having a pattern in glass on the viewing end with the opposite end having a smaller opening with a translucent lens to allow the entry of light to illuminate the viewing end. The targets may be sealed and filled with nitrogen to eliminate fogging and a fitting is provided on the rear of the target to accept a collimator lighting source for night bore sighting. A parallax shield is also provided to narrow the field of vision through either of the sighting telescopes to make the sight picture more accurate.

5 Claims, 10 Drawing Figures

BORE SIGHTING APPARATUS

BACKGROUND OF THE INVENTION

1. Field of the Invention

The present invention is directed to a bore sighting apparatus and more specifically to a pair of detachable targets adapted to be secured adjacent the muzzle of the tube for aligning the pantel and elbow telescopes on a howitzer.

2. Prior Art

The principal method currently in use for sighting a large caliber gun such as an M110 self-propelled howitzer involves the use of a target set in front of the gun at some distance with the two sights on the gun focusing on the target in a particular manner. Such a sighting method is impractical and sometimes even impossible where the terrain is uneven and the wind and weather conditions are such as to prevent the carrying out of an accurate sighting procedure.

Another prior art method involves the use of a distant aiming point which should have well defined vertical and horizontal axes at least 1500 meters distant. Such a distant aiming point is not always available and the method is clearly unusable under adverse conditions involving fog or darkness.

U.S. Pat. No. 1,994,177, to Nolan, granted Mar. 12, 1935 is directed to a bore sighting apparatus for large caliber guns wherein a pair of collimators are secured parallel to each other on a collimator frame which in turn is mounted directly in the muzzle of the gun for aligning the two sighting telescopes adjacent the breech.

U.S. Pat. No. 43,319 to Maltby granted June 28, 1864 is directed to an ordinance sight which may be mounted adjacent the muzzle of a gun by means of an adjustable band extending about the circumference of the gun. This forward sight is used in conjunction with a rear sight which is mounted on the knob of the cascabel.

SUMMARY OF THE INVENTION

The present invention provides a new and improved bore sighting apparatus which is adapted to be mounted adjacent the muzzle of the gun to provide accurate adjustable target means for aligning the pantel and elbow telescope sights. By having the target means mounted directly on the gun, all of the aforementioned difficulties encountered with respect to the movable target method and distant aiming methods are eliminated.

The present invention provides a new and improved target means for use in bore sighting which may be readily attached to and removed from the barrel of the gun adjacent the muzzle. The target means may be readily adjustable for proper vertical alignment and are easily replaceable in case of damage.

The present invention provides a new and improved bore sighting apparatus comprising an alignment device adapted to be clamped on the gun adjacent the muzzle by means of a hinged split-ring having a clamp for securing the ring. A pair of horizontal arms extend outwardly from opposite sides of the ring and a pair of vertical arms are hinged at the outermost ends of the horizontal arms respectively. A target having a leveling vile is secured to the top of each vertical arm and a turnbuckle-type device is connected between the upper end of each vertical arm and the respective horizontal arm for adjusting the vertical arm to a true vertical position. A pair of hinged witness sights are mounted on either side of the clamping ring in alignment with the horizontal arms so that the witness sights may be used on tubes with or without a muzzle brake.

The present invention provides a new and improved target device for the bore sighting apparatus comprised of a cylinder having a pattern in glass on the viewing end and a translucent lens located in the smaller opening at the opposite end to allow in light to illuminate the viewing end. The targets are sealed and filled with nitrogen to eliminate fogging and a fitting is provided on the rear of the target to accept a collimator lighting source for night bore sighting. A parallax sheild of plastic material is also provided to narrow the field of vision through the telescope making the sight picture more accurate.

The foregoing and other objects, features and advantages of the invention will be apparent from the following more particular description of a preferred embodiment of the invention as illustrated in the accompanying drawings.

DETAILED DESCRIPTION OF THE INVENTION

The bore sighting apparatus according to the present invention is suitable for use with various large caliber guns and for the purposes of the present application will be described in conjunction with an M110 self-propelled howitzer. This is a highly mobile combat support weapon having a hydraulic suspension lock-out system which effectively harnesses the shock of firing and transmits the shock directly to the ground through the locked suspension system thus making the vehicle an extremely stable firing platform.

The definition of bore sighting is the process of aligning the on-carriage sighting and fire control equipment so that the lines of sight of the pantel telescope and the elbow telescope are parallel to the axis of the bore. The purpose of bore sighting is to ensure accuracy in laying the tube. Bore sighting is conducted before firing and, when necessary, during lulls in firing and therefore, it is essential that the bore sighting apparatus is readily mountable and demountable adjacent the muzzle of the tube.

Figure 1:
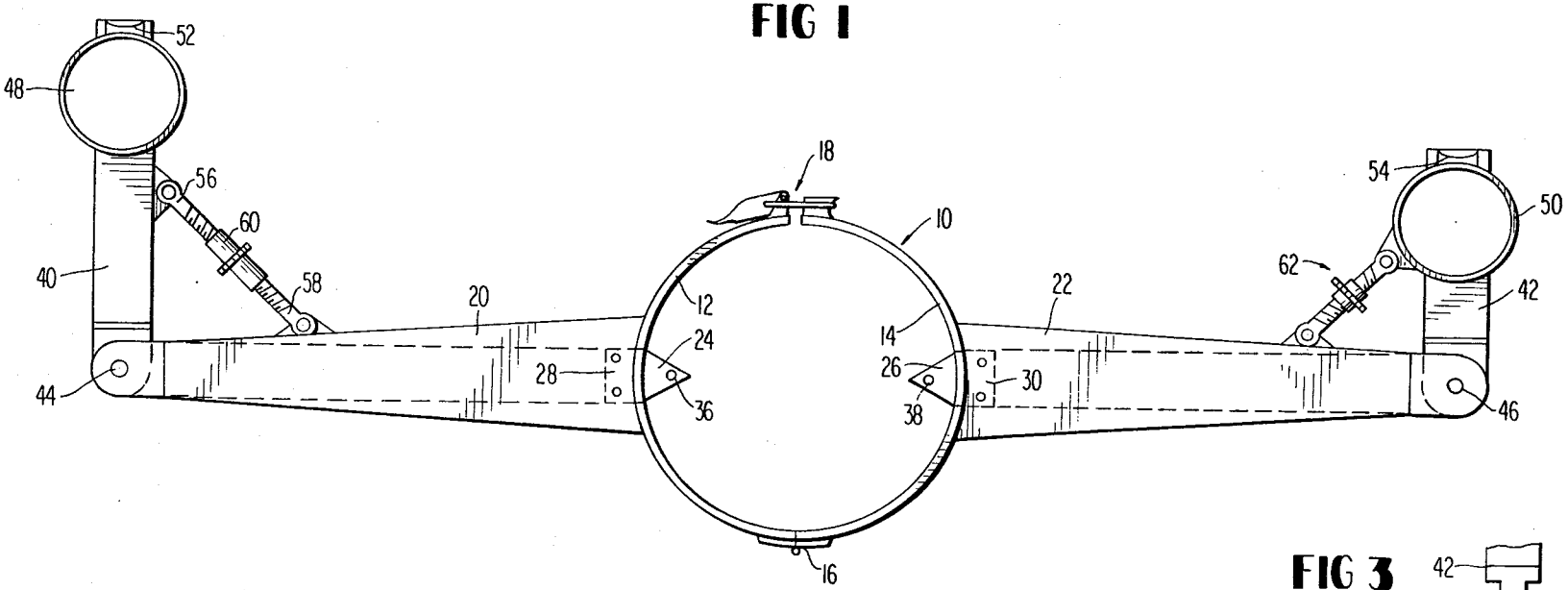
FIG. 1 is a front elevation view of the bore sighting apparatus according to the present invention.
Figure 3:
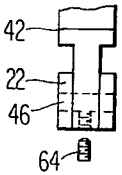
FIG. 3 is a detailed end view of the hinge between the vertical arm and the horizontal arm of FIG. 1 with the locking set screw removed.
Figure 2:
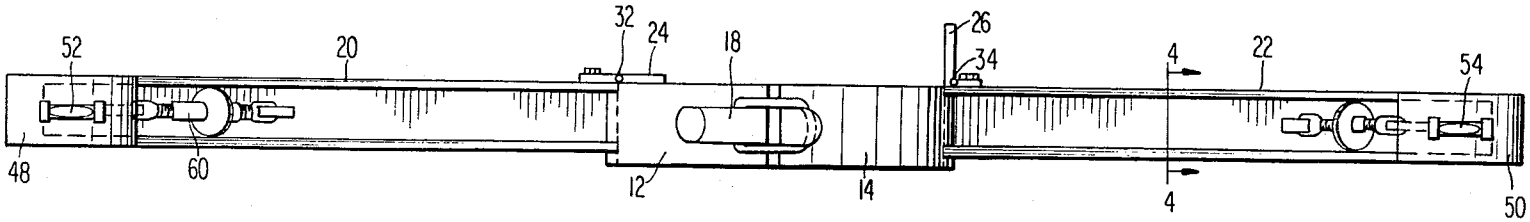
FIG. 2 is a top plan view of the bore sighting apparatus shown in FIG. 1.
Figure 4:
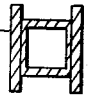
FIG. 4 is a sectional view taken along the line IV—IV of FIG. 2.
Figure 10:
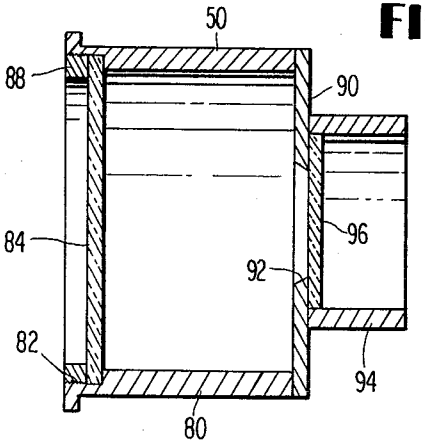
FIG. 10 is a side elevation view in section of a target according to the present invention.
Figure 9:
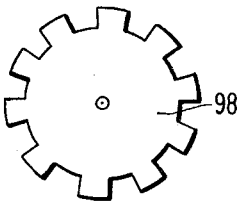
FIG. 9 is an end elevational view of the parallax shield for use with the target according to the present invention.
Figure 8:
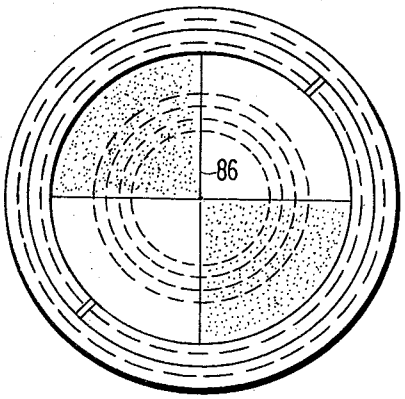
FIG. 8 is an elevational view of a target according to the present invention.
Figure 6:
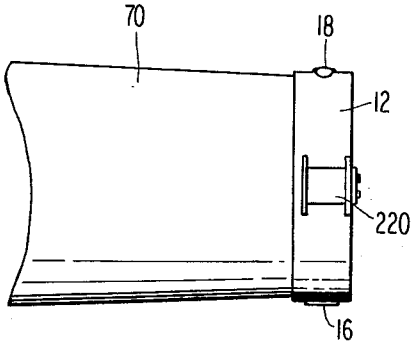
FIG. 6 is a side elevation view of the apparatus as shown in FIG. 5.

The bore sighting apparatus as shown in FIG. 1 is comprised of a clamping ring 10 which is formed of two semi-circular ring members 12 and 14 connected together by a hinge 16 at the bottom of the ring and by a spring type clamp 18 at the top of the ring. The inside of the ring should be lined with a thin soft rubber pad or the like (not shown) to keep the ring from slipping on the muzzle. A pair of horizontally extending arms 20 and 22 are secured to and extend outwardly from the sides of the rings 12 and 14, respectively. A pair of witness sights 24 and 26 are hinged to mounting plates 28 and 30 respectively which in turn are secured to the arms 20 and 22 by means of bolts, rivets or the like. The hinges 32 and 34 for the witness sights 24 and 26 respectively are of the piano hinge type and are disposed in substantial alignment with the periphery of the ring members 12 and 14. The witness sights 24 and 26 have a substantially triangular shape with the two apexes being opposed to each other on a common horizontal line which also extends the length of the arms 20 and 22. Each witness sight 24 and 26 is also provided with a small hole 36 and 38 respectively through which the witness marks on the side or end of the tube may be viewed in order to properly align the horizontal arms 20 and 22 relative to the tube as will be described in greater detail hereinafter.

A pair of vertically disposed arms 40 and 42 are pivotally secured to the outer ends of the arms 20 and 22 by means of hinges 44 and 46. Targets 48 and 50 are secured at the upper end of each arm and leveling viles 52 and 54 are mounted on top of targets 48 and 50 respectively. A pair of oppositely threaded studs 56 and 58 are pivoted to the arms 40 and 20 respectively and are coupled together by means of an internally threaded sleeve 60. Upon turning the sleeve 60 in one direction, the ends of the threaded studs 56 and 58 will be drawn towards each other and upon turning the sleeve 60 in the opposite direction the opposed ends of the threaded studs 56 and 58 will be moved apart from each other so as to adjust the angle between the arms 20 and 40 until the arm 40 is disposed in the vertical position as determined by the leveling vile 52. An identical adjusting device 62 is provided for adjusting the upper arm 42 to the vertical position as determined by a leveling vile 54. A set screw 64 is threaded into the lower end of the arm 42 to secure the hinge pin 46 thereto.

Figure 5:
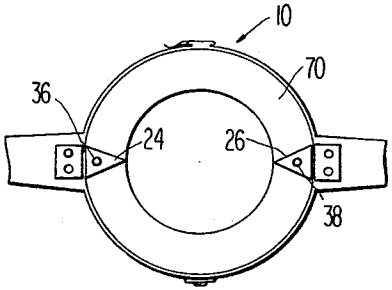
FIG. 5 is a front elevation view of the bore sighting apparatus secured adjacent the muzzle with the horizontal arms broken away.
Figure 7:
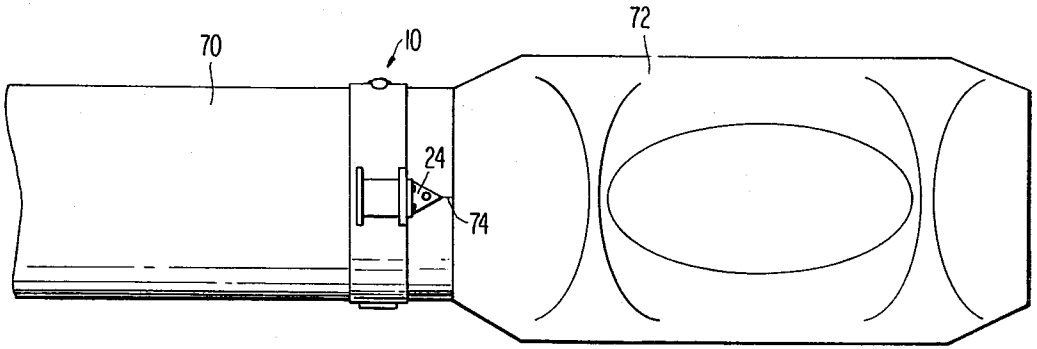
FIG. 7 is a view similar to FIG. 6 showing the bore sighting apparatus secured to a tube having a muzzle brake thereon.

When the clamping ring 10 is secured to the muzzle end of a tube 70 which is not provided with a muzzle brake as shown in FIG. 5, the witness sights 24 and 26 may be pivoted into a common plane against the end of the tube 70 with the alignment marks on the end of the tube being visible through the holes 36 and 38. The apexes of the triangular shaped witness sights 24 and 26 may also be used as the indicators for alignment with the witness marks on the end of the tube 70. Since the witness marks are disposed beneath the witness sights 24 and 26 they are not visible as viewed in FIG. 5. When a muzzle brake 72 is mounted on the end of the tube 70, the ring clamp 10 may be moved back from the end of the tube and the witness sights 24 and 26 pivoted outwardly so as to be disposed against the sides of the tube 70. The apex of each witness sight or the aperture therein may then be aligned with a witness mark 74 to properly align the bore sighting apparatus with the muzzle.

The two targets 48 and 50 are identical in construction with the target 48 being mounted higher than the target 50 since the corresponding sight on the howitzer is higher than the one associated with the target 50. Since the individual targets are identical in construction the details of construction will be described with respect to the target 50. The target is comprised of a tubular sleeve 80 having a threaded annular recess 82 adjacent one end thereof for receiving a circular glass plate 84 having a cross-hair type target 86 thereon which may be painted, etched or applied by any suitable method. The glass plage 84 is secured in the recess by means of a threaded annular ring 88. An end plate 90 is secured to the opposite end of the sleeve 80 and is provided with a central opening 9. A second tubular sleeve 94 is secured to the end plate 90 by any suitable means such as welding or the like and a translucent glass plate 96 is secured therein by any suitable means such as an adhesive or the like. The translucent plate 96 allows light to enter the larger diameter tubular sleeve to illuminate the target. A light source (not shown) may also be fitted into the tubular sleeve 94 so that the target may be used at night. The plates 84 and 96 should be hermetically sealed and the interior of the sleeve 80 between the two plates is filled with nitrogen to eliminate fogging. The parallax shield 98 may be used to narrow the field of vision through the pantel or elbow telescopes to make the sight picture more accurate. The parallax shield can be made of plastic or any other suitable material.

In using the bore sighting apparatus according to the present invention, the tube is lowered to a minimum elevation and the alignment device is attached to the muzzle with the witness sights aligned with the witness marks on the end of the tube. The vertical arms 40 and 42 are then adjusted to the vertical position using the leveling viles 52 and 54. From the gunner's seat, the elevation scale on the pantel is set at zero using the elevation knob. The cross-level vile is then leveled with the cross-level knob. The parallax shield 98 is placed in the pantel eye piece and the target 48 is sighted in. The upper azimuth counter should read 3200. If not, the bore sight adjustment shaft is depressed and the shaft is rotated until the azimuth counter reads 3200. From the assistant gunner's seat, the cross-level vile is leveled using the cross-level knob. The parallax shield is placed in the eye piece of the elbow telescope and the target 50 is sighted in. The cross-hair in the elbow telescope should line up with the cross-hair on the target. If not, the elevation locking lever is turned to release the elevation screw. The screw is rotated until the cross-hair of the telescope reticle is centered on the target. The elevation locking lever is returned to the original position. The deflection locking lever is then loosened and the deflection adjusting cam is rotated until a vertical cross-hair of the reticle is superimposed on the target. The locking screw is then tightened. The weapon is now bore sighted and the alignment device is removed from the muzzle.

While the invention has been particularly shown and described with reference to a preferred embodiment thereof, it will be understood by those in the art that various changes in form and detail may be made therein without departing from the spirit and scope of the invention.

What is claimed is:

1. A bore sighting apparatus comprising clamping ring means adapted to be clamped adjacent the muzzle end of a tube, a pair of horizontally disposed arms secured to said ring means and extending outwardly therefrom in opposite directions, a pair of witness sight means hingedly secured to said arms adjacent said ring for alignment with witness marks on said tube, a pair of vertically disposed arms pivotally secured to the ends of said horizontally disposed arms respectively and target means mounted on each of said vertically disposed arms for use with the sights adjacent the breach end of said tube.

2. A bore sighting apparatus as set forth in claim 1, wherein said clamping ring means is comprised of a pair of semi-circular ring members, hinge means connecting two adjacent ends of said members and spring clamp means detachably connecting the other ends of said members.

3. A bore sighting apparatus as set forth in claim 1, further comprising leveling means mounted on each target means and adjustment means interconnected between the horizontally disposed arm and the vertically disposed arm on each side of said clamping ring means for adjusting the angular disposition of each vertically disposed arm relative to the respective horizontally disposed arm.

4. A bore sighting apparatus as set forth in claim 1, wherein each target means is comprised of a cylindrical sleeve, first lens means having a reticle thereon secured in one end of said sleeve, a centrally apertured plate secured to the other end of said sleeve and second lens means covering the central aperture, said first and second lens means and said plate being hermetically sealed to define an air tight enclosure filled with an inert gas.

5. A bore sighting apparatus as set forth in claim 4, further comprising additional sleeve means surrounding said second lens means adapted to support a light source.

* * * * *